US006956530B2

(12) United States Patent
Kadambi et al.

(10) Patent No.: US 6,956,530 B2
(45) Date of Patent: Oct. 18, 2005

(54) COMPACT, LOW PROFILE, SINGLE FEED, MULTI-BAND, PRINTED ANTENNA

(75) Inventors: Govind Rangaswamy Kadambi, Lincoln, NE (US); Sripathi Yarasi, Lincoln, NE (US); Theodore Samuel Hebron, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 64 days.

(21) Appl. No.: 10/314,791

(22) Filed: Dec. 9, 2002

(65) Prior Publication Data

US 2004/0056804 A1 Mar. 25, 2004

Related U.S. Application Data

(60) Provisional application No. 60/412,406, filed on Sep. 20, 2002.

(51) Int. Cl.[7] ..... H01Q 1/24
(52) U.S. Cl. ..... 343/702
(58) Field of Search ..... 343/700 MS, 846, 343/895, 850, 873, 893, 702, 793

(56) References Cited

U.S. PATENT DOCUMENTS 4,152,565 A 5/1979 Rose ..... 200/291
6,144,344 A * 11/2000 Kim et al. ..... 343/770
6,421,014 B1 * 7/2002 Sanad ..... 343/700 MS
6,459,413 B1 * 10/2002 Tseng et al. ..... 343/702
6,518,937 B2 * 2/2003 Fang ..... 343/895
6,639,560 B1 10/2003 Kadambi et al. ..... 343/702
6,642,893 B1 * 11/2003 Hebron et al. ..... 343/702
2003/0174092 A1 9/2003 Sullivan et al. ..... 343/702

* cited by examiner

*Primary Examiner*—Shih-Chao Chen
*Assistant Examiner*—Minh A. Dieu
(74) *Attorney, Agent, or Firm*—Holland & Hart LLP

(57) ABSTRACT

Printed circuit techniques and two-shot molding techniques are used to form a metal radiating element, a metal ground plane element, a metal antenna feed, a metal short-circuiting strip and metal capacitive loading plates within small antennas that are buried within transmit/receive radio-devices such a mobile cellular telephones. Balanced and unbalanced, single-feed, two and three band antennas are provided wherein the radiating element is laterally spaced from the ground plane element, to thereby provide an antenna having a very low profile or height, including antennas wherein the ground plane element and the radiating element are placed coplanar on the same surface of a PCB. A thin dielectric carriage on a PCB allows for the metal capacitive loading plates to be placed on the sidewalls of the dielectric carriage, to thereby provide reactive loading of a radiating element that is on the top surface of the dielectric carriage.

11 Claims, 4 Drawing Sheets

COMPACT, LOW PROFILE, SINGLE FEED, MULTI-BAND, PRINTED ANTENNA

This United States non-provisional patent application claims the benefit of U.S. provisional patent application serial No. 60/412,406 entitled COMPACT, LOW PROFILE, SINGLE FEED, MULTI-BAND, PRINTED-ANTENNA filed on Sep. 20, 2002, incorporated herein by reference.

FIELD OF THE INVENTION

This invention relates to the field of radio communication, and more specifically to antennas for use with, or buried within, relatively small radio communication devices, of which mobile cellular telephones are a non-limiting example.

BACKGROUND OF THE INVENTION

In wireless voice and data communications systems, including mobile systems having multi-band and multi-system capabilities, reducing the physical size of the radio transmit/receive devices, such as mobile cellular telephones, is an important design consideration.

For radiating/receiving antennas that are buried within the radio-devices (i.e. internal-antennas), the need to reduce the physical size of the radio-devices imposes a severe constraint on the physical volume within each radio-device that is allowed for an internal-antenna and its radiating/receiving element (hereafter called radiating element).

A planar inverted-F antenna (PIFA) is commonly used as a radio-device's internal-antenna. A reduction in the physical volume that is available within the radio-device for housing the PIFA's radiating element results in a negative impact on both the bandwidth and the gain of the PIFA.

In addition, with a trend toward restricting the height of such internal-antennas to from about 3 millimeters (mm) to about 5 mm, it is difficult to provide a multi-band PIFA that has a requisite bandwidth and gain.

Although it may be that a PIFA design that is associated with a photonic band gap (PBG) structure can be used to overcome the negative effects of such a reduced height, the associated geometric configuration that is imposed by the design of a ground plane for such a PIFA that includes the PBG phenomenon is difficult.

Therefore, antenna configurations that feature some or most of the advantages of a PIFA, and yet require a smaller volume than a conventional PIFA, are of great value to antenna and system designers.

The present invention makes use of printed circuit techniques. The use of printed circuit techniques in antennas is known, as shown for example in U.S. Pat. Nos. 5,754,145, 5,841,401, 5,949,385, 5,966,096 and 6,008,774, incorporated herein by reference.

In an embodiment of the invention wherein a multi-band printed-antenna (under unbalanced conditions) has its radiating element formed on a printed circuit board (PCB) so as to be coplanar with, but physically spaced from, a ground plane element that is also formed on the PCB, the printed-antenna resembles a multi-band, printed, inverted-F antenna (printed-IFA).

A single band IFA is described by C. Soras et al. in an article entitled "Analysis and Design of an Inverted-F Antenna Printed On a PCMCIA Card for the 2.4 GHz ISM Band", IEEE APS Magazine, Vol. 44, No.1, February 2002, pp. 37–44.

In an embodiment of the invention wherein a multi-band printed-antenna has its radiating element located on the top surface of a hollow, four-sided and box-like dielectric carriage that is supported by a PCB, such that the radiating element is parallel to, but is spaced from, a ground plane element that is formed on the PCB, the printed-antenna resembles a meander-line antenna.

Prior art meander-line antennas provide for the meander-line radiating element to be placed on a PCB itself, whereas this invention provides that the radiating element of the printed-antenna is located on a separate dielectric surface that is provided at a desired height above, and laterally spaced from, the ground plane element. For example the ground plane element is placed on a PCB that is located within a radio device, this PCB also incorporating the circuit components of the radio-device. For example, the ground plane element also functions as a ground potential for the radio-device's communication circuitry.

Embodiments of the present invention provide that the generally flat radiating element is located on a different plane than the generally flat ground plane occupies, these two planes being generally parallel, and embodiments of the invention provide for the shorting of a point on the radiating element to a point on the ground plane Unlike prior known meander-line antennas, the present invention provides a dielectric carriage whose sidewalls provide for the reactive loading (for example capacitive loading) of the printed-antenna's radiating element. This reactive loading is provided by one or more conductive metal strips or plates that extend downward from one or more edges of the meander-line radiating element, generally flush with the outer surface of one or more sidewalls of the dielectric carriage. This reactive loading aids in lowering or controlling the resonant frequency of the printed-antenna, without increasing the physical length of the printed-antenna's meander-line radiating element.

An advantage of the present invention is that a physically compact, low profile, simple geometry, single-feed, planar and printed-antenna in accordance with the invention provides multi-band performance with satisfactory gain and bandwidth.

Structural configurations of various embodiments in accordance with this invention are cost-effective and easy to manufacture.

The requisite bandwidth performance of multi-band, planar and printed-antennas in accordance with this invention is realized without requiring the use of an impedance matching network that is external to the printed-antenna.

In spite of the constraints on an internal-antenna's geometry that is provided by the manufacturers of radio-devices such as cellular telephones, this invention provides viable printed-antenna embodiments that are physically compact, that provide for a single-feed, that are multi-band, and that provide satisfactory gain and bandwidth performance.

SUMMARY OF THE INVENTION

This invention provides embodiments of single-feed, multi-band, planar and printed-circuit antennas that are physically compact, and that have a low profile or height.

The various embodiments of this invention have utility in commercial applications requiring multi-band cellular voice operation, as well as RF data operation, including use within laptop computer applications.

More specifically, printed-antennas in accordance with this invention include single-feed, two-band or three-band printed-antennas whose height is in the order of about 3 mm, including printed-antennas wherein the radiating element is formed on a PCB that is within a radio-device and is used for other functions within the radio-device.

Embodiments of printed-antennas in accordance with this invention include a radiating element whose surface profile is laterally spaced from a ground plane, and may be either parallel to the ground plane, or perpendicular to the ground plane.

The construction and arrangement of planar and multi-band printed-antennas in accordance with the invention are optimized for both balanced conditions and unbalanced conditions.

In a balanced condition, printed-antennas in accordance with the invention do not provide a direct physical connection between the radiating element and the ground plane or chassis of the radio-device.

In an unbalanced condition, printed-antennas in accordance with the invention provide a direct electrical connection between a segment of the radiating element and the ground plane.

When the radiating element is directly electrically connected to the ground plane (i.e. the unbalanced condition), the short-circuit connection between the radiating element and the ground plane lowers the resonant frequency or frequencies of the radiating element, without increasing the physical dimensions of the radiating element.

The physical position of this short-circuit relative to the physical position of the radiating element's feed point, as well as the width of this short-circuit, also provide tuning parameters that can be used to tune the resonant frequency or frequencies of the radiating element, and to effect impedance matching.

The use of such a short-circuit between the radiating element and the ground plane also provides higher levels of cross polar radiation, this increase being a consequence of increased excitation of currents on the ground plane, which in turn is due to the presence of the short-circuit between the radiating element and the ground plane.

Multi-band, planar, printed-antennas in accordance with the invention can also be categorized as planar monopole antennas. However, unlike monopole antennas that include a linear wire-like radiating element, printed-antennas in accordance with the invention resemble a PIFA having the important distinction that the radiating element of the printed planar monopole is not associated with a ground plane that is located directly under its radiating element.

In one embodiment of the invention, multi-band performance is provided by a printed-antenna whose radiating element resembles a meander-line that is formed on a PCB that functions as, or simulates, the grounded chassis of a radio-device.

Three-band (AMPS/PCS/BT) performance of such a printed-antenna is provided by a radiating element having a planar area that is about 37 mm in width and about 12 mm in length. In an additional embodiment of the invention, a two-band (GSM/DCS) printed-antenna includes a printed-radiating element having a planar area that is about 33 mm in width and about 13 mm in length. Since the printed radiating element is formed on one surface of a PCB, the profile or height of the printed-antenna is very small, and generally comprises only the thickness of the PCB.

Single-feed, multi-band, printed-antenna of this embodiment of the invention provide a desired bandwidth performance, they are devoid of an external impedance matching network, and they operate in either a balanced condition or an unbalanced condition.

In another embodiment of the invention, the above-mentioned embodiment of the invention is modified to form a radiating element on the top surface of a box-like dielectric carriage that is located on the top surface of a PCB that is within a radio-device such as a cellular telephone. The construction and arrangement of such a radiating element located on the top of the dielectric carriage, and the associated feed mechanism for the radiating element, is such that the antenna structure offers easy and simple integration onto the PCB or chassis of a radio-device.

In this embodiment of the invention, the radiating element can be formed such that the generally flat surface of the radiating element is parallel to the top surface of the dielectric carriage and the top surface of the PCB, or the radiating element is perpendicular to the top surface of the dielectric carriage and the top surface of the PCB. Therefore the radiating element can be positioned such that it is either parallel to the ground plane that is carried by the PCB, or it is perpendicular to the ground plane that is carried by the PCB.

This embodiment of the invention also provides a multi-band printed-antenna that is functional in either a balanced condition or an unbalanced condition.

As was true for the above-described embodiments of the invention, single-feed, multi-band (GSM/DCS) performance of printed-antennas in accordance with this embodiment of the invention do not require an external impedance matching network.

An example of the size of such a multi-band printed-antenna is about 33 mm in width, about 13 mm in length, and about 3 mm in height, wherein the antenna's radiating element extends generally parallel to, but is laterally spaced from, a ground plane that is carried by a PCB that is within a radio-device.

Yet another embodiment of the invention provides a multi-band planar printed-antenna having a low profile or height of about 3 mm. Like the previous embodiment, this embodiment of the invention also does not include a ground plane that is located directly under the antenna's radiating element. Thus, this antenna resembles a planar monopole antenna. However, unlike a linear monopole antenna, impedance matching is accomplished in accordance with this invention without the need for an external impedance matching network, and it does not require the discrete electronic components that are required by an external impedance matching network.

As is known in multi-band PIFA designs, this embodiment of the invention includes an U-shaped slot that is formed within the radiating element, to thus provide multi-band performance of the printed-antenna.

In this manner two-band (GSM/DCS) performance is provided by a printed-antenna in accordance with the invention having a width of about 33 mm, a length of about 13 mm, and a height of about 3 mm.

In summary, the present invention provides embodiments of two-band and three-band printed-antennas that are very compact, having a very low profile or height, wherein a portion of the antenna's radiating element is directly electrically connected to the antenna's ground plane by way of a short-circuit (i.e. an unbalanced condition), or wherein a portion of the antenna's radiating element is not directly electrically connected to the antenna's ground plane (i.e. a balanced condition).

Structural configurations of planar printed-antennas in accordance with this invention facilitate the formation of the antenna's radiating element either on the top surface of, or on the sidewalls of, a dielectric carriage that is carried by a PCB that in turn carries a ground plane at a location that is laterally spaced from the radiating element.

Integration of printed-antennas in accordance with the invention into, or onto, the PCB or chassis of a radio-device is facilitated by the use of a conductive feed lead (i.e. the balanced condition), or a conductive feed lead and a conductive shorting lead (i.e. the unbalanced condition), which conductive lead or leads can be physically located generally flush with the outer surface of the sidewalls of a dielectric carriage. This use of external conductive leads simplifies integration of the printed-antenna into the radio-device.

Printed-antennas in accordance with the invention provide for the choice of either a balanced condition or an unbalanced condition for a multi-band printed-antenna. The use of a balanced condition ensures a desirable antenna performance even when the antenna's radiating element is isolated from the chassis of the radio-device.

In embodiments of the invention, tuning parameters which facilitate independent control of lower and upper resonance characteristics of two/three band printed-antennas in accordance with the invention can be identified.

DETAILED DESCRIPTION OF THE INVENTION

Figure 1:
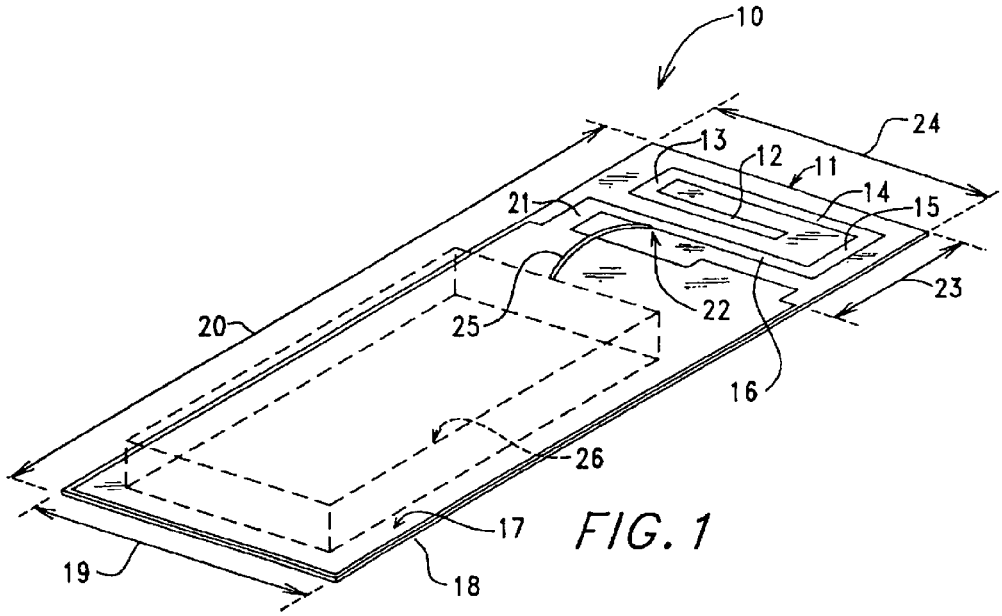
FIG. 1 is a top perspective view of a single-feed, two-band, printed-antenna in accordance with the invention, wherein the antenna's five-segment, meander-line-type, metal radiating element is formed on one end of the top surface of a PCB that functions as a support member such as a chassis within a radio-device, the antenna's metal meander-line radiating element being coplanar with, and laterally spaced from, the antenna's metal ground plane element that is also formed on the top surface of the PCB, the ground plane element being short-circuit connected to one segment of the radiating element by way of a printed circuit connection, to thereby provide an unbalanced condition of the antenna.

FIG. 1 is a top/side/end perspective view of a single-feed, two-band (GSM band and DCS band), printed-antenna 10 in accordance with the invention that is located in a small area on one end of PCB 18.

Reference numeral 17 identifies a flat, relatively large area and top-located metal surface of a PCB 18 that functions in a well known manner as a chassis within a radio-device such as a cellular telephone, wherein dimensions 19 and 20 generally correspond to the width and the length of a cellular telephone. Metal surface 17 may function as a ground-potential connection for components of a cellular telephone, wherein these components are represented by a dotted-box 26.

Antenna 10 includes a metal printed circuit radiating element 11 that is made up of five metal segments, i.e. inner segment 12, segment 13 that extends generally perpendicular from one end of segment 12, segment 14 that extends generally perpendicular from one end of segment 13, segment 15 that extends generally perpendicular from one end of segment 14, and segment 16 that extends generally perpendicular from one end of segment 15. As such, radiating element 11 can be called a rectangular spiral.

In accordance with this embodiment of the invention, the large-area and planar metal surface 17 also functions as the ground plane element 17 of antenna 10, this ground plane element 17 being coplanar with, and being laterally spaced from, radiating element 11, i.e. radiating element 11 does not have a ground plane element located directly thereunder.

This embodiment of the invention provides an unbalanced antenna 10 by providing a printed circuit metal segment 21 that short-circuit connects one end of metal radiating element segment 16 to metal ground plane 17.

A point 22 on radiating element segment 16 comprises an antenna feed point, and a discrete electrical conductor 25 connects antenna feed 22 to the electronic/electric circuit components 26 that are within the radio-device that utilizes PCB 18 as a chassis of the radio-device.

By way of a non-limiting example, the volume that is occupied by antenna 10 has a height that is generally equal to the thickness of PCB 18, a length 23 of about 12 mm and a width 24 of about 33 mm.

Figure 2:
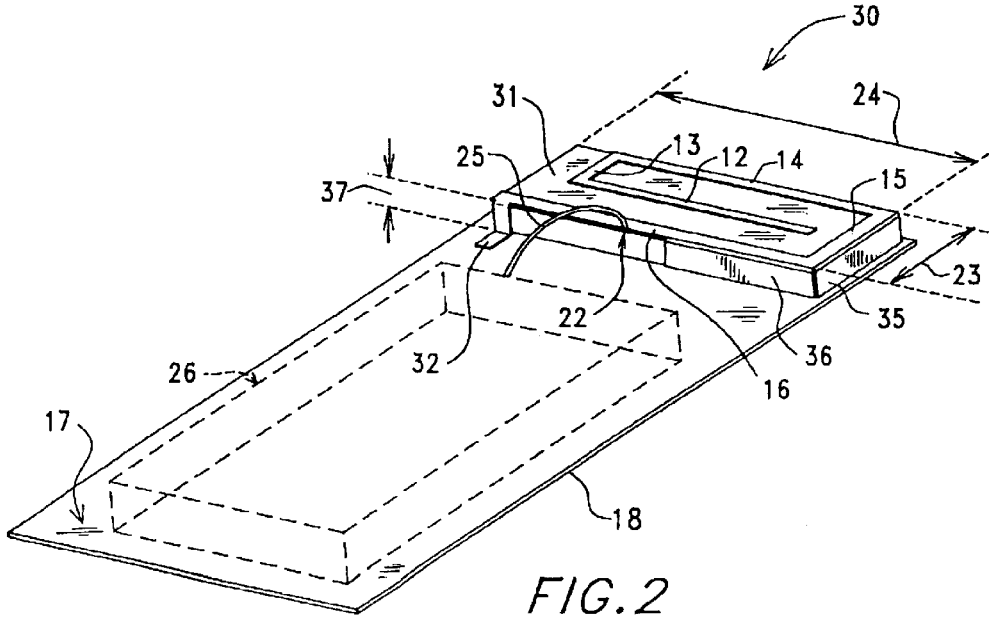
FIG. 2 is a top perspective view of a single-feed, two band, printed-antenna in accordance with the invention that is somewhat similar to FIG. 1, wherein the antenna's five-segment, meander-line, metal radiating element is formed on the top surface of a hollow, box-like, dielectric carriage whose four sidewalls are carried by one end of the FIG. 1 PCB that carries the metal ground plane element, with the top surface of the dielectric carriage being generally parallel to the ground plane element, with the ground plane element being short-circuit connected to one segment of the radiating element by way of a discrete wire or metal strip connection to thereby provide an the unbalanced condition for the antenna, and having side-located and downward-extending metal plates that provide for reactive loading of the antenna.

FIG. 2 is a top and side perspective view of a single-feed, two band, printed-antenna 30 in accordance with the invention that is somewhat similar to FIG. 1.

Antenna 30 differs from antenna 10 of FIG. 1 mainly in that antenna 30 includes a hollow, four-sided and box-like dielectric carriage 31 having a generally flat top surface that is defined by the top surfaces of the carriage's four sidewalls, and a generally flat bottom surface that is generally parallel to the top surface and is defined by the bottom surfaces of the carriage's four walls, with this bottom surface being mounted on, or carried by, one end of the FIG. 1 PCB 18 that carries metal ground plane element 17.

The four sidewalls of dielectric carriage are, for example, about 2 mm thick, this being the dimension that extends generally parallel to the top surface of dielectric carriage 31.

The dielectric carriages that are mentioned in this detailed description are preferably formed of a plastic material having a dielectric constant of from about 2.5 to about 3.0. For example the plastic materials polycarbonate, acrylonitrite-butadiene-styrene (ABS), and high-density-polyethylene (HDPE) can be used to make dielectric carriage 31.

In FIG. 2 the antenna's five-segment 12–16, printed-circuit, metal radiating element 11 is formed on the generally flat top surface of dielectric carriage 31, such that the top surface is generally parallel to PCB 18 and ground plane element 17.

Again, antenna 30 is an unbalanced antenna in that radiating segment 16 is electrically connected to ground plane element 17 by way of a discrete wire connection 32 that is soldered to one end of radiating segment 16 and to ground plane element 17.

The use of dielectric carriage 31 in the FIG. 2 construction and arrangement allows for the provision of one or more downward extending metal plates 35 and 36, these metal plates lie flush with the sidewalls of dielectric carriage 31 and function as reactive loading plates 35 and 36 for antenna 30. These loading plates help in independently controlling the resonant bands of the antenna. For example, loading plate 36 mainly controls the upper resonant frequency band.

The upper edge of each of the metal plates 35 and 36 is electrically connected to, or is integrally formed with, the two adjacent radiating segments 15 and 16, respectively.

In an embodiment of the invention the height 37 of dielectric carriage 31 was about 3 mm.

Within the spirit and scope of the invention, dielectric carriage 31 can also be formed by a two-shot molding process wherein the carriage's second-shot plastic material is metallized to provide the above-described radiating segments and loading plates.

Figure 3:
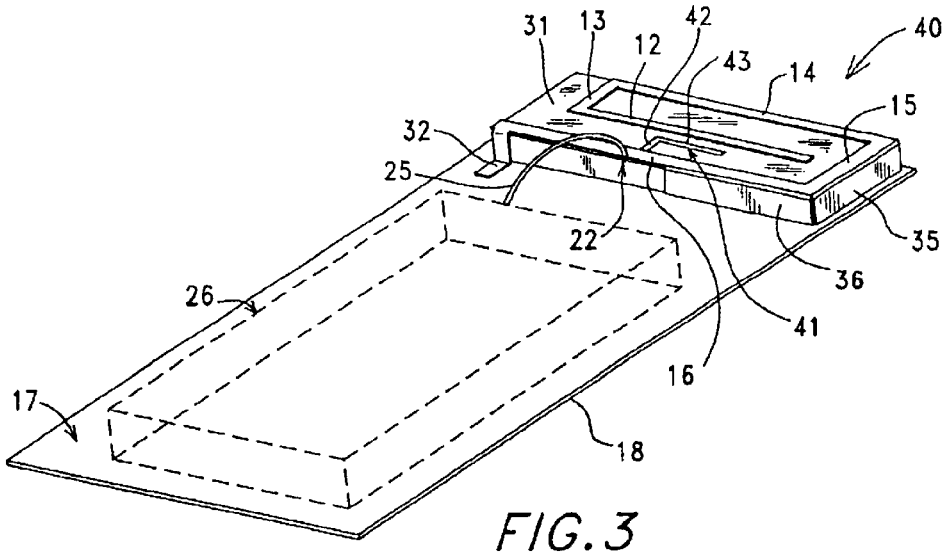
FIG. 3 is a view similar to FIG. 2 that shows a single-feed, three-band, printed-antenna in accordance with the invention wherein the metal meander-line radiating element includes an additional metal L-shaped segment.

FIG. 3 shows a single-feed, three-band (AMPS band, PCS band and BT band), printed-antenna 40 in accordance with the invention wherein antenna 40 is generally the same as antenna 30 of FIG. 2, with the exception that the radiating element of antenna 40 includes an additional L-shaped printed-circuit metal segment 41 that extends from a generally mid-portion of radiating element segment 16, toward radiating segment 12. More specifically, L-shaped segment 41 includes a first metal portion 42 that extends generally perpendicular to radiating segment 16, and a second metal portion 43 that is spaced from and extends generally parallel to radiating segment 12.

Figure 4A:
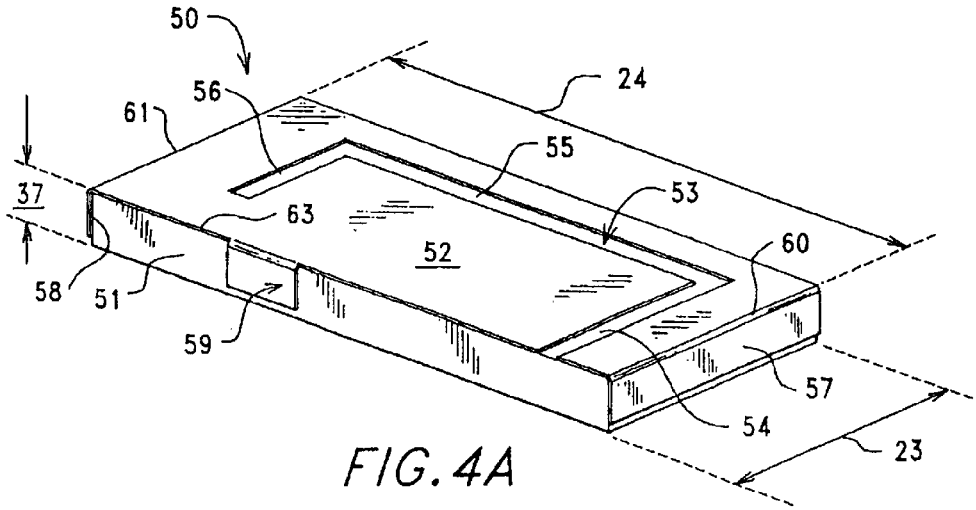
FIG. 4A is a perspective view of a single-feed, dual-band, balanced, printed-antenna in accordance with the invention wherein only the four-sidewall dielectric carriage is shown, this antenna including a flat and plate-like metal radiating element that includes a generally U-shaped slot having three slot segments, having side-disposed and downward-extending metal loading plates, and having a metal antenna feed that extends downward from one edge of the radiating element
Figure 4B:
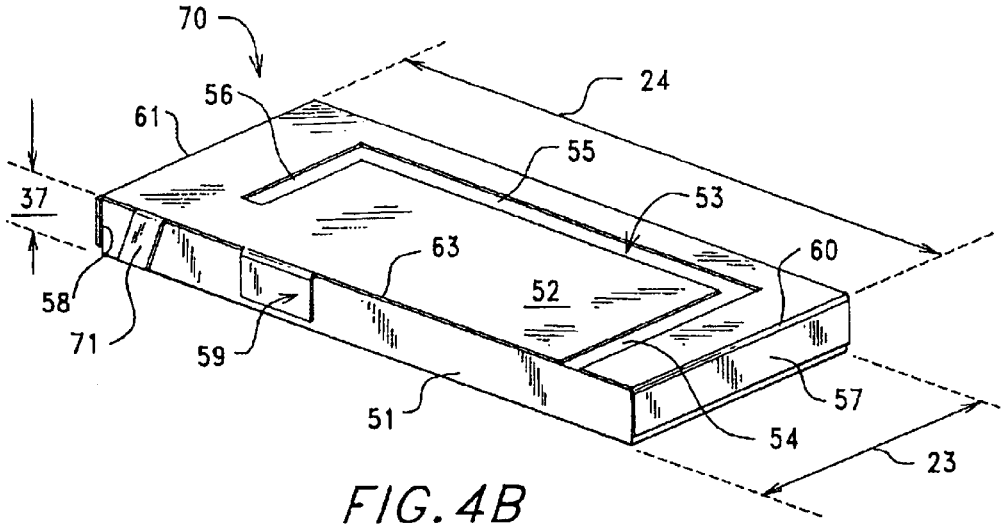
FIG. 4B is a view similar to FIG. 4A wherein the antenna is an un-balanced antenna by virtue of short-circuit metal stub that is laterally spaced from the antenna feed and is electrically connected to the PCB's ground plane element, for example the PCB shown in FIG. 2.

FIGS. 4A and 4B illustrate two other embodiments of the invention wherein only the dielectric carriage of each embodiment is shown. For example, the dielectric carriages that are shown in FIGS. 4A and 4B replace the dielectric carriage that is shown in FIG. 2.

FIG. 4A is a perspective view of a single-feed, dual-band, balanced, printed-antenna 50 in accordance with the invention wherein only a four-sidewall dielectric carriage 51, as above-described, is shown.

Antenna 50 includes a flat and plate-like metal radiating element 52 having a generally U-shaped slot 53 formed therein, slot 53 being formed by three generally linear slot segments 54, 55 and 56.

Antenna 50 also includes at least two, side-disposed, and downward-extending metal loading plates 57 and 58 that are integrally formed with, or are electrically connected to, the two opposite edges 60 and 61 of radiating element 52.

A metal antenna feed 59 is integrally formed with, or is electrically connected to, the edge 63 of radiating element 52.

FIG. 4B is a view similar to FIG. 4A wherein an antenna 70 is an un-balanced antenna by virtue of short-circuit metal stub 71 that extends downward from the edge 63 of radiating element 52. Short-circuit stub 71 is laterally spaced from antenna feed 59, short-circuit stub 71 and is electrically connected to the PCB's ground plane element, for example PCB 18 and ground plane 17 shown in FIG. 1.

The three dimensions 23, 24 and 37 of the two dielectric carriages that are shown in FIGS. 4A and 4B are generally identical to dimensions above-described relative to FIGS. 2 and 3.

Figure 5A:
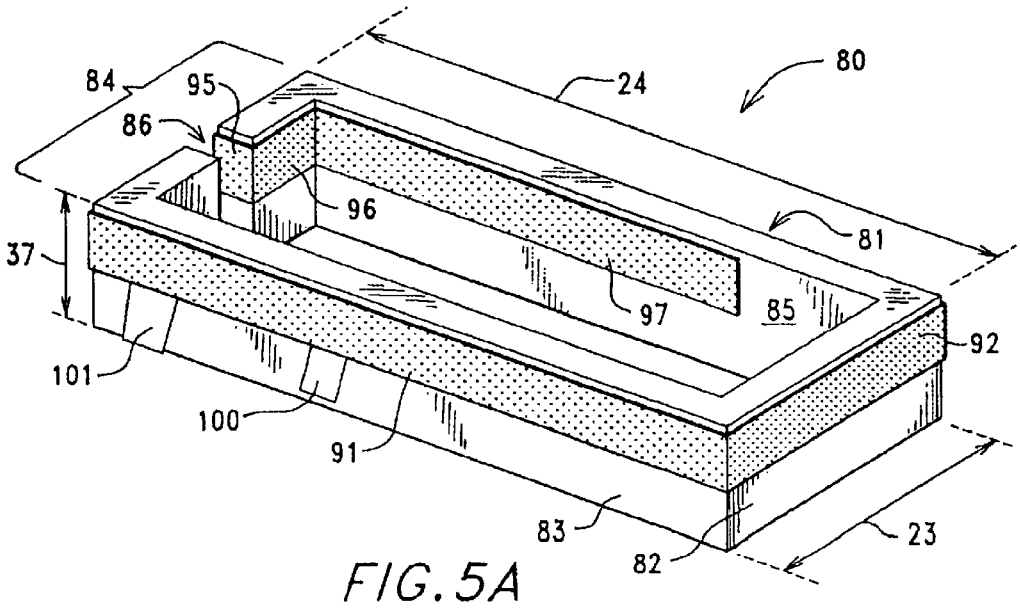
FIG. 5A is a perspective view of a single-feed, three-band, un-balanced, printed-antenna in accordance with invention wherein only the dielectric carriage is shown, this dielectric carriage including an eight-segment metal radiating element that is located on the inner and the outer surfaces of the four sidewalls of the dielectric carriage, this antenna including a downward-extending antenna-feed strip and a downward extending short-circuit strip that is electrically connected to the PCB's ground plane element, for example the PCB shown in FIG. 2.
Figure 5B:
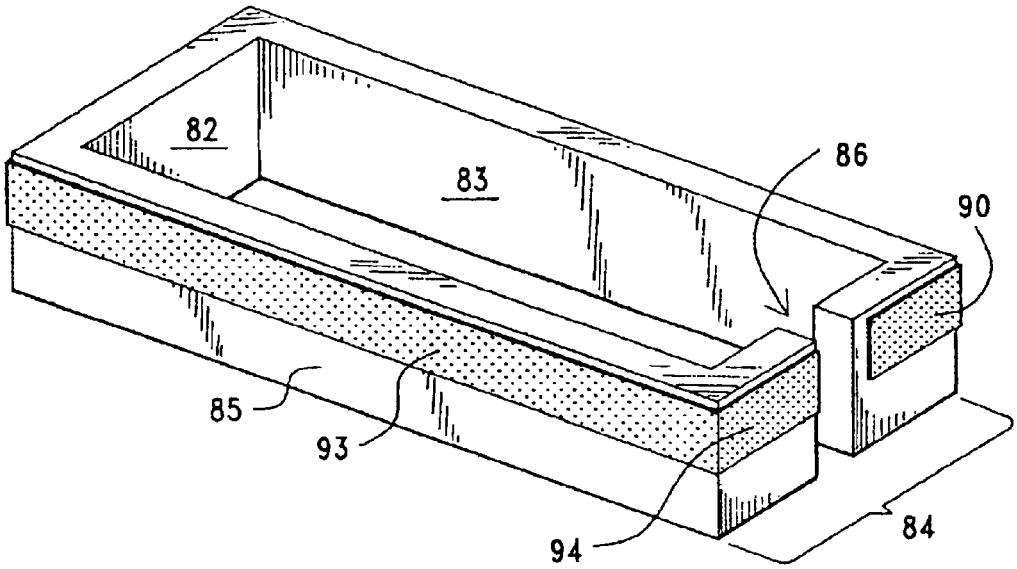
FIG. 5B shows the exterior surface of two sidewalls of the dielectric carriage that are hidden in FIG. 5A.

FIGS. 5A and 5B are two different perspective views of another multi-band embodiment of the invention wherein the antenna's printed-radiating element includes eight generally linear metal segments that individually lie in planes that extend generally perpendicular to the plane of a ground plane element with which the radiating element is associated, and wherein these eight metal segments also occupy a common plane that is spaced above, and is generally parallel to, this ground plane element. For example, the dielectric carriage shown in FIGS. 5A and 5B replaces the dielectric carriage that is shown in FIG. 2.

FIG. 5A is a perspective view of a single-feed, multi-band, un-balanced, printed-antenna 80 in accordance with invention wherein a four-sidewall dielectric carriage 81 is shown, with FIG. 5B showing the exterior surface of the two sidewalls of dielectric carriage 81 that are hidden in FIG. 5A.

Dielectric carriage 81 includes four generally orthogonally-arranged sidewalls 82, 83, 84 and 85. Note that in this embodiment of the invention dielectric carriage wall 84 includes a gap 86 that is not required in any sidewall of the various above-described dielectric carriages, gap 86 being provided to facilitate placement of the eight-segment radiating element of antenna 80 on the inner and the outer surfaces of the four sidewalls of dielectric carriage 81.

The eight metal segments that make up the radiating element of FIGS. 5A and 5B comprise segment 90 (FIG. 5B), segment 91 (FIG. 5A), segment 92 (FIG. 5A), segment 93 (FIG. 5B), segment 94 (FIG. 5B), segment 95 (FIG. 5A), segment 96 (FIG. 5A) and segment 97 (FIG. 5A).

As shown in FIG. 5A, antenna 80 of FIGS. 5A and 5B includes a metal feed strip 100 that extends from radiating segment 91, and antenna 80 is an unbalanced antenna by virtue of a short-circuiting strip 101 that extends from radiating element 91 at a location that is spaced from feed strip 100. Shorting strip 101 is provided to facilitate the direct electrical connection of radiating segment 91 to a ground plane element, for example ground plane element 17 of FIG. 2.

A further embodiment of the invention comprises a combination of (1) a radiating element such as is shown in FIGS. 5A and 5B and (2) a radiating element such as is shown in FIGS. 2, 3, 4A and 4B.

That is, in this embodiment of the invention a dielectric carriage is provided, a first radiating element is located on the top surface of the dielectric carriage so as to be parallel to but not coplanar with the ground plane, and a second radiating element is located on the surfaces of the sidewalls of the dielectric carriage so as to be located above and so as to extend generally perpendicular to the ground plane.

While the above detailed description relates primarily to the use of printed circuit techniques to form the radiating element, the ground plane element, the antenna feed, and the short-circuiting strip of the various above-described antennas, it is within the spirit and scope of the invention to fabricate antennas as above-described using a two-shot molding process wherein the second-shot plastic material is metallized to form these metal portions of the antenna.

In summary, the various embodiments of the invention provide both balanced and unbalanced single-feed antennas wherein a radiating element is laterally spaced from a ground plane element, so as to provide an antenna having a very low profile or height. As a result antennas in accordance with the invention are especially useful within small hand-held radio-devices such as cellular telephones.

This antenna profile or height is the smallest when the antenna's metal ground plane element and metal radiating element are formed on the same surface of a PCB, i.e. the ground plane and the radiating element are co-planar.

However, with the use of a thin dielectric carriage, the profile or height of the antenna is increased by only a small amount, and metal loading plates can be provided on the sidewalls of the dielectric carriage, to thereby provide for reactive loading of the antenna, these metal loading plates also facilitating the independent control of the antenna's resonant frequency bands.

The radiating element of embodiments of the invention is provided in geometric forms that facilitate the provision of dual-band and tri-band antennas.

Since other embodiments of the invention will be readily apparent to those of skill in the art, it is not intended that the above detailed description be taken as a limitation on the spirit and scope of the invention.

What is claimed is:

1. A low profile antenna, comprising:

a printed circuit board having a metal ground plane element on a first portion of one surface of said printed circuit board;

a single metal radiating element on a second portion of said one surface of said printed circuit board, said metal radiating element being coplanar with, and laterally spaced from, said ground plane element;

a short-circuiting metal strip on said one surface of said printed circuit board, said short-circuiting metal strip extending from said second portion of said printed circuit board to said first portion of said printed circuit board, and directly connecting a portion of said radiating element to said ground plane element; and a metal antenna feed strip extending from said radiating element;

said single radiating element being formed in a one-part geometric configuration to provide a multi-band response, the multi-band response for said antenna being a function of said geometric configuration.

2. The low profile antenna of claim 1 wherein said printed circuit board is contained within a hand-held, transmit/receive, radio communication device, including:

electrical transmit/receive components for said radio communication device on said first portion of said one surface of said printed circuit board;

said electrical components having an output/input terminal;

said metal ground plane element providing a common source of potential such as a ground potential for said electrical components; and means connecting said antenna feed strip to said output/input terminal.

3. The low profile antenna of claim 1 wherein said metal radiating element is in the form of a spiral metal pattern.

4. The low profile antenna of claim 3 wherein said spiral metal pattern comprises a generally rectangular spiral having a plurality of generally straight metal segments.

5. The low profile antenna of claim 4 including a generally L-shaped metal segment extending from one of said plurality of metal segments so as to provide an additional band of response for said antenna.

6. A mobile radio-device, comprising:

a printed circuit board having a metal ground plane element on a first portion of said printed circuit board;

electrical circuitry for said mobile radio-device physically associated with said ground plane element, said ground plane element providing a common-electrical-potential connection, such as a ground connection, for said electrical circuitry;

a metal antenna radiating element consisting of only one part on a second portion of said printed circuit board, said antenna radiating element being coplanar with, and laterally spaced from, said ground plane element;

said antenna radiating element being formed in a geometric configuration, the geometric configuration providing a multi-band response for said mobile radio-device;

a short-circuiting metal strip on said one surface of said printed circuit board, said short-circuiting metal strip extending from said second portion of said printed circuit board to said first portion of said printed circuit board, and directly connecting a portion of said radiating element to said ground plane element; and a metal antenna feed strip extending from a first portion of said antenna radiating element to said electrical circuitry.

7. A low profile antenna, comprising:

a printed circuit board having a metal ground plane element on a first portion of one surface of said printed circuit board;

a metal radiating element on a second portion of said one surface of said printed circuit board, said metal radiating element being coplanar with, and laterally spaced from, said ground plane element;

a metal antenna feed strip extending from said radiating element; and a short-circuiting metal strip on said one surface of said printed circuit board, said short-circuiting metal strip extending from said second portion of said printed circuit board to said first portion of said printed circuit board, and directly connecting a portion of said radiating element to said ground plane element.

8. The low profile antenna of claim 7 wherein said radiating element is formed in a rectangular-spiral geometric configuration, so as to provide multi-band response for said antenna.

9. The low profile antenna of claim 8 wherein said printed circuit board is contained within a hand-held, transmit/receive, radio communication device, including:

electrical transmit-receive components for said radio communication device on said first portion of said one surface of said printed circuit board;

said electrical components having an output/input terminal;

said metal ground plane element providing a common source of ground potential for said electrical components; and means connecting said antenna feed strip to said output/input terminal.

10. A mobile radio-device, comprising:

a printed circuit board having a metal ground plane element on a first portion of said printed circuit board;

electrical circuitry for said mobile radio-device physically associated with said ground plane element, said ground plane element providing a common-electrical-potential connection, such as a ground connection, for said electrical circuitry;

a metal antenna radiating element on a second portion of said printed circuit board, said antenna radiating element being coplanar with, and laterally spaced from, said ground plane element;

a metal antenna feed strip extending from a first portion of said antenna radiating element to said electrical circuitry; and a short-circuiting metal strip on said printed circuit board, said short-circuiting metal strip extending from said second portion of said printed circuit board to said first portion of said printed circuit board, and directly connecting a second portion of said antenna radiating element to said ground plane element, said second portion of said antenna radiating element being physically spaced from said first portion of said antenna radiating element.

11. The mobile radio-device of claim 10 wherein said antenna radiating element is formed in a geometric configuration that provides multi-band response for said mobile radio-device.

* * * * *